US006279912B1

(12) United States Patent
Martin et al.

(10) Patent No.: US 6,279,912 B1
(45) Date of Patent: Aug. 28, 2001

(54) METHOD AND APPARATUS FOR OPERATING TUG-OF-WAR STYLE ELECTRONIC DART GAMES

(75) Inventors: John R. Martin; Timothy J. Ward, both of Rockford, IL (US)

(73) Assignee: Arachnid, Inc., Rockford, IL (US)

( * ) Notice: Subject to any disclaimer, the term of this patent is extended or adjusted under 35 U.S.C. 154(b) by 0 days.

(21) Appl. No.: 09/120,677

(22) Filed: Jul. 22, 1998

(51) Int. Cl.[7] ..... F41J 3/02

(52) U.S. Cl. ..... 273/371; 273/408; 463/7; 463/53; 463/54; 463/56

(58) Field of Search ..... 273/371, 454, 273/460, 85 G, DIG. 28, 376–7, 373–4, 317.1–317.9, DIG. 26, 102 B, 451–2, 102.2 R, 102.2 S, 106.5 R, 106.5 B, 408–9, 1, 138 A; 340/32 BR; 700/91–3; 463/7, 53, 54, 56

(56) References Cited

U.S. PATENT DOCUMENTS

| | | | | |
|---|---|---|---|---|
| 3,979,117 | * | 9/1976 | Worsham | 273/102 B |
| 4,752,069 | * | 6/1988 | Okada | 273/1 |
| 4,793,618 | | 12/1988 | Tillery et al. | 273/376 |
| 4,893,822 | * | 1/1990 | Tesa et al. | 273/376 |
| 5,020,806 | * | 6/1991 | Martin | 273/371 |
| 5,020,807 | * | 6/1991 | Barkley | 273/409 |
| 5,156,643 | * | 10/1992 | Grubek | 273/376 |
| 5,370,306 | * | 12/1994 | Schulze et al. | 273/138 A |
| 5,401,033 | | 3/1995 | Lychock, Jr. | 273/371 |
| 5,540,445 | | 7/1996 | Lee | 273/371 |
| 5,664,782 | * | 9/1997 | Lacks et al. | 273/317.5 |
| 5,681,044 | * | 10/1997 | Houriet, Jr. et al. | 273/371 |
| 5,711,528 | * | 1/1998 | Pan | 273/371 |
| 5,755,443 | * | 5/1998 | Huang | 273/371 |
| 5,871,215 | * | 2/1999 | Butts | 273/371 |
| 5,967,518 | * | 10/1999 | Rowe | 273/317.5 |
| 5,979,898 | * | 11/1999 | Pan | 273/371 |

FOREIGN PATENT DOCUMENTS 296 16 424 1/1997 (DE) .

* cited by examiner

*Primary Examiner*—Valencia Martin-Wallace
*Assistant Examiner*—Carmen D. White
(74) *Attorney, Agent, or Firm*—McAndrews, Held & Malloy, Ltd.

(57) ABSTRACT

The present invention provides an apparatus for playing and method of controlling a computerized dart game of simulated tug-of-war. The method generates on a display a goal graphic, at least one player graphic, and at least one challenger graphic. The goal graphic typically includes a first side on which the player graphic is initially displayed and a second side on which the challenger graphic is initially displayed. The method monitors the segments in at least one electronic dart board for hits by darts and determines at least one offset value associated with a segment hit by a dart. The offset value may represent the sum of one or more hits by a player, the sum of one or more hits by a challenger, of the difference between one or more by a player and hits by a challenger. In a single player game, the method itself may generate a random challenger value. The method further adjusts, on the display, the position of the player graphic in relation to the first side of the goal and adjusts the position of the challenger graphic in relation to the second side of the goal. The amount of adjustment is based on the offset value. When the challenger graphic is adjusted to cross the second side of the goal graphic, the method declares the player a winner and when the player graphic is adjusted to cross the first side of the goal graphic, the method declares the challenger a winner.

46 Claims, 2 Drawing Sheets

METHOD AND APPARATUS FOR OPERATING TUG-OF-WAR STYLE ELECTRONIC DART GAMES

BACKGROUND OF THE INVENTION

The present invention relates to computer controlled games. In particular, the present invention relates to a computer dart game which allows players to engage in a simulated tug-of-war contest.

The ancient game of darts has long been a mainstay of bars, restaurants, and even homes. Many versions and variants of darts exist, including, for example, Cricket and Random Cricket. Only recently, however, have inventors applied modern electronics and computer technology to the game of darts and thereby allowed entirely new developments in and variations of dart based games.

Electronic dart games and associated electronics are disclosed, for example, in U.S. Pat. Nos. 5,401,033 to Lychock, Jr., 4,057,251 to Jones et al., 4,561,660 to Zammuto, and 4,586,716 to Brejcha et al. The Lychock, Jones, Zammuto, and Brejcha patents are incorporated herein by reference in their entireties. The Lychock patent, for instance, discloses an electronic dart game with a random target number generator that may be used to play a random Cricket game. The Lychock dart game randomly generates target values for display on an electronic dart board, and fixes for future reference only those values marked by a dart hit during a player's turn. Because the target values change while the game is being played, more interesting, challenging, and exciting play results.

Recent developments in computerized dart games have also provided a video display associated the dart game. The video display may show the current scores, advertisements, diagnostic information, and the like. Such an electronic dart game is disclosed in U.S. Pat. No. 4,824,121 to Beall et al. The Beall patent is incorporated herein by reference in its entirety.

Furthermore, entirely new possibilities for multiple player competitive or cooperative play have been provided by the Multiple Target Electronic Dart Game disclosed by Martin in U.S. Pat. No. 5,020,806. In the Martin patent, two independent electronic dart boards operate under the supervision of a single microcontroller. A display also operates under control of the microcontroller and may show player scores in a split screen display (for independently played games) or in a single display (for multi-player competitive or cooperative games). The Martin patent is incorporated herein by reference in its entirety.

Although (as illustrated above) current electronics technology has provided the hardware for new interesting and exciting dart games, few such dart games have been created. In particular, few, if any, dart games are known that take advantage of the display to provide anything other than a simple display of the current scores. In addition, no known games are available that take advantage of the dual player nature of the Multiple Target Dart Game disclosed by Martin for anything other than a simple display of scores. Without new and exciting games, of course, it is more difficult for dart game manufacturers to sell their games and for operators to maintain interest (and therefore profitability) in their games once installed.

A need has long existed in the industry for new and entertaining computerized dart games.

BRIEF SUMMARY OF THE INVENTION

It is an object of the present invention to provide a computerized tug-of-war dart game.

It is another object of the present invention to provide engaging graphics associated with a computerized tug-of-war dart game.

Yet another object of the present invention is to provide a single player tug-of-war dart game.

Another object of the present invention is to provide a multiplayer tug-of-war dart game.

A still further object of the present invention is to provide a tug of war dart game using multiple independent electronic dart boards.

The present invention provides an apparatus for playing and method of controlling a computerized dart game of simulated tug-of-war. The method generates on a display a goal graphic, at least one player graphic, and at least one challenger graphic. The goal graphic typically includes a first side on which the player graphic is initially displayed and a second side on which the challenger graphic is initially displayed. The player graphic may correspond to player 1, while the challenger graphic may correspond to player 2, for example.

The method monitors the segments in at least one electronic dart board for hits by darts and determines at least one offset value associated with a segment hit by a dart. The offset value may represent the sum of one or more player values, the sum of one or more challenger values, or the difference between one or more player or challenger values. In a single player game, the method itself may generate a random challenger value. The offset value calculation is not limited to sums and differences, but may be determined by any function.

The method further adjusts, on the display, the position of the player graphic in relation to the first side of the goal and adjusts the position of the challenger graphic in relation to the second side of the goal. The amount of adjustment is based on the offset value. When the challenger graphic is adjusted to cross the second side of the goal graphic, the method declares the player a winner and when the player graphic is adjusted to cross the first side of the goal graphic, the method declares the challenger a winner.

Preferably, the method monitors two (or more) independent electronic dart boards. Each dart board may be connected to and controlled by a single controller. The single controller may then scan each dart board in turn to determine the segments hit by darts thrown by the player and the challenger.

DETAILED DESCRIPTION OF THE INVENTION

Figure 1:
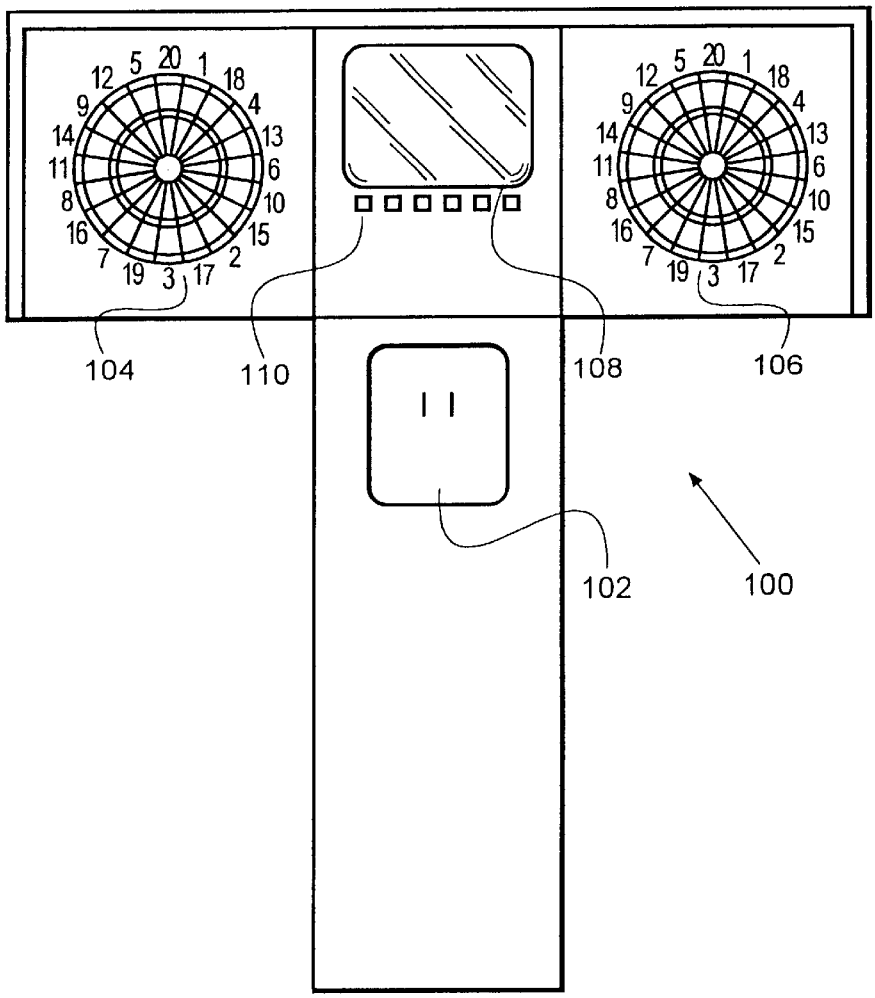
FIG. 1 illustrates one embodiment of a multiple target dart game which may be used to play a simulated tug-of-war game.

Turning now to FIG. 1, one embodiment of a computerized dart game 100 is illustrated. The dart game 100 includes a player interface 102, a first electronic dart board 104, and a second electronic dart board 106. The dart game 100 also includes a display 108 and several interface keys 110.

The player interface 102 includes, for example, coin slots with associated coin mechanisms, coin return slots, dollar bill acceptors and the like. Additionally, game selection controls, one (or more) player start buttons or other inputs may be provided on the player interface 102. Alternatively, one or more of the inputs may be implemented with the interface keys 110.

It is noted that the interface keys 110 and player interface 102 are not necessarily the only sources of player input. For example, a touchscreen (not shown) may be provided on the display 108 and controlled by a processor in the dart game 100. The display 108 itself may then present the user with various game selection choices which may be activated by pressing the appropriate location on the touchscreen.

The display 108 may vary widely in implementation. For example, the display 108 may be a Cathode Ray Tube (CRT) based display, a Liquid Crystal Display (LCD), or even a dense grid of Light Emitting Diodes (LEDS). The characteristics of the display 108 may vary as well. For example, the display may be color or monochrome, or may vary in size from a 9 inch or smaller display to a 21 inch or larger display. The dart game 100 may also provide video output connectors that provide standard connections to VGA, NTSC, or S-Video displays. The display may then be mounted in a location remote from the dart game 100 itself.

The dart game 100 includes a first electronic dart board 104. Optionally additional electronic dart boards (for example, the second electronic dart board 106) may be connected to a processor in the dart game 100 to provide nearly simultaneous play. Suitable electronic dart boards 104 may be obtained from Arachnid, Inc. of Rockford, Ill. and may be implemented, for example, as described in U.S. Pat. No. 4,057,251.

The electronic dart board 104 may include, for example, a set of switches (which may be magnetic, mechanical, or optical) associated with each segment (including double mark, triple mark, and bullseyes) for each target value on the dart board 104. When a dart hits a segment, one of the switches associated with the segment closes. By scanning the set of switches with a general purpose bus, a processor determines which switch has closed and may therefore determine the associated segment and target value.

Figure 2:
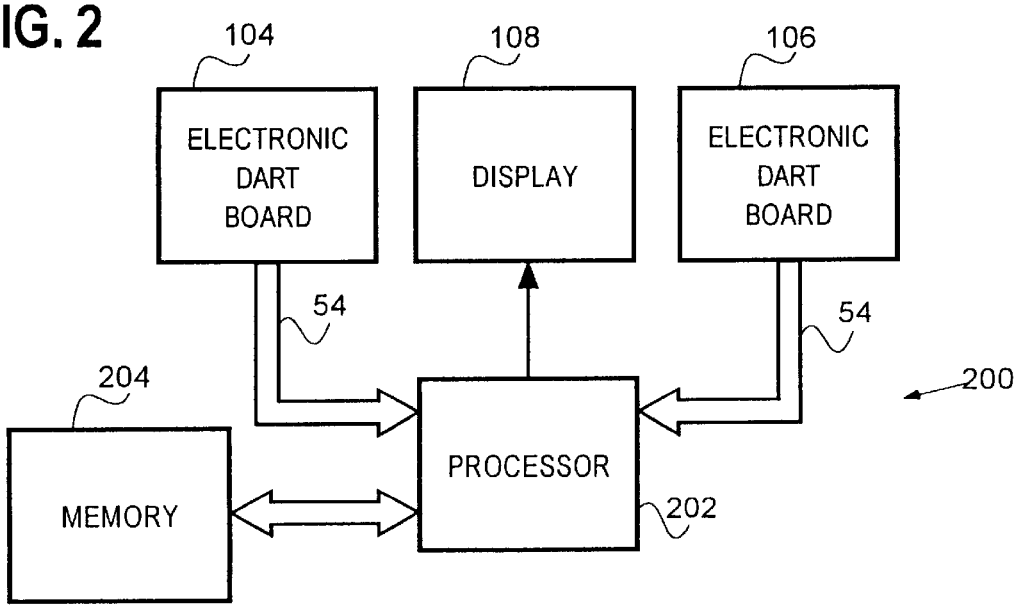
FIG. 2 shows a simplified block diagram of the hardware components associated with the multiple target dart game of FIG. 1.

Turning now to FIG. 2, one example of the hardware configuration 200 of the dart game 100 is shown. The hardware configuration 200 includes the display 108, the first electronic dart board 104, and the second electronic dart board 106. A central processor 202 connects to the first and second electronic dart boards 104 and 106 and the display 108. A memory 204 provides the processor 202 with memory resources and may include banks of RAM, ROM, flash memory, EEPROM, or magnetic memory.

The processor 202 may be implemented with a single processor unit, for example, a processor available from Motorola, Texas Instruments, or Intel. Alternatively, the processor 202 may be implemented with discrete logic, programmable logic, or a combination of a high level processor core and discrete logic. In operation, the processor 202 generally operates according to the software flow shown in FIG. 3.

Figure 3:
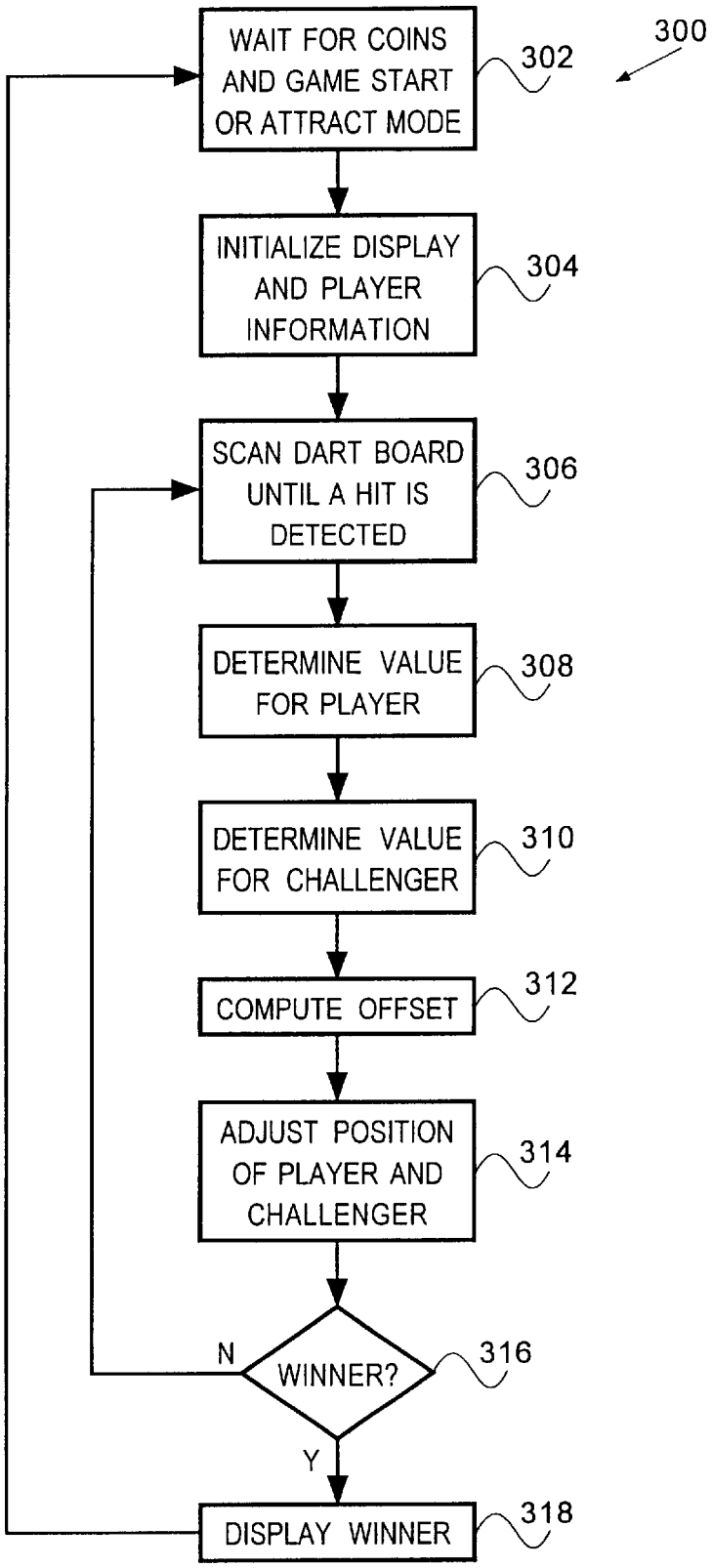
FIG. 3 illustrates one example of the processing flow associated with a computerized tug-of-war dart game.

Turning now to FIG. 3, a flowchart 300 illustrates one of many possible implementations of a program for a computerized tug-of-war dart game. The processor 202 executes instructions stored in the memory 204 which correspond to the steps illustrated in FIG. 3. The steps shown in FIG. 3 generally correspond to a two player game of computerized tug-of-war darts. Modifications to the steps in FIG. 3 will be explained below and cover, for example, one player play and attract mode operation.

Starting with step 302, the instructions generally wait for one or more players to insert money into the dart game 100 and press the start button for one player or two players. Alternatively, the instructions may start an attract mode periodically which illustrates the features of the game and how it is played. Next, at step 304, the instructions clear the display, player scoring totals, and the like.

The instructions at step 304 further generate graphics on the display 108 including a player graphic, a challenger graphic, and a goal graphic. As noted above, the player graphic is typically associated with player 1, or the first player to throw darts. The challenger graphic is typically associated with player 2. The player and challenger graphics may be drawn as a series of individuals holding a rope, for example. Of course, alternate graphics including, for example, robots, dragons, and dinosaurs, may be provided and may be selected by each player using the interface keys 110.

The instructions for step 304 also generate the goal graphic, which typically includes a first side on which the player graphics are initially placed and a second side on which the challenger graphics are initially placed. As an example, the goal graphic may be a mud pit, with one side of the pit closest to the player graphics and a second side of the pit closest to the challenger graphics. Other goal graphics are also suitable, and may be chosen by players using the interface keys 110.

Next, operation moves to step 306, in which the instructions cause the processor 202 to scan the dart board 104 for dart hits. In a dart game 100 with a single dart board 104, the processor may assume, for example, that the players alternate and therefore alternate dart hits are to be assigned in an alternating fashion to the player and the challenger. The dart game 100 may make use of a "skip turn" interface key 110 to provide for the situation in which the player or challenger misses the dart board 104 altogether. The processor may alternatively assume, for example, that sets of three, two darts for the player and three for the challenger, or any other dart throwing schedule may be used by the player and challenger. The dart throwing schedule may be selected using the interface keys 110 before the game starts.

If running in an attract mode, the instructions for step 306 may chose the dart segments hit by the player and challenger in a random fashion. It is also noted that in attract mode, the dart game 100 does not have to finish each example game completely. Rather, the attract mode may terminate at any point, in particular, when money has been inserted into the dart game 100.

If multiple electronic dart boards are used, the instructions for step 306 may scan the first dart board 104 for hits by the player and separately scan the second dart board 106 for hits by the challenger. The instructions may assume any dart throwing schedule, or may assume a lack of a schedule altogether. For example, the player and the challenger may throw darts as quickly as possible at their respective targets without limitations on taking turns.

As noted above, the switches associated with each segment on the dart board 104 allow the processor 202 to determine which segment has been hit. The instructions at steps 308 and 310 assign a player value and a challenger value associated with the particular segment that was hit. Thus, the values may correspond to the standard 1–20 plus bullseye values, including double and triple scores or may correspond to an arbitrary assignment or randomly assigned set of values to segments.

At step 312, instructions compute an offset based on the player value and the challenger value. The offset determines how far to move the player graphics and the challenger graphics toward or away from their respective sides of the goal graphic. As an example, assume that the player value is 15 and the challenger value is 20. A combined offset may be calculated as (15−20=−5*scale) where "scale" coverts the difference between the player value and challenger value to a pixel count. A positive pixel count may then adjust the challenger toward the second side of the goal (and correspondingly the player graphic away from the first side of the goal). A negative pixel count may adjust the challenger away from the second side of the goal (and correspondingly the player graphic toward the first side of the goal).

Many modifications on the instructions associated with step 312 are possible. For example, difficulty levels may be implemented which fact or down, or otherwise reduce a player's value or challenger's value. In another embodiment, particularly one using multiple dart boards 104 and 106, individual offsets may be determined separately for the player and the challenger based on their respective values as each player's dart hits the first dart board 104 and as each challenger's dart hits the second dart board 106. Furthermore, in a one player game, the challenger value may be determined in step 310 randomly and influenced by game parameters such as difficulty level.

Next, in step 314, the position of the player graphics and the challenger graphics are adjusted according to individual or combined offsets as computed in step 312. As an example, the instructions may interpret a positive offset to adjust the player graphic away from the first side of the goal and interpret a negative offset to adjust the challenger graphic away from the second side of the goal. It is noted that the processor 202 generally stores the current position of the player graphic and the challenger graphic in the memory 204.

At step 316, instructions determine whether there is a winner based in part on the current positions of the player and challenger graphics. If not, processing returns to step 306, and is so, processing continues to step 318. Determining a winner may be done in many ways. For example, the winner may be the player when the last portion of the challenger graphic has crossed the second side of the goal graphic (and thus, the challenger has been pulled into the mud pit).

In one embodiment, the player or challenger graphics may include more than one individual (for example, five persons on each side by default and further configurable with the interface keys 110). Then, for example, as the challenger graphic crosses the second side of the goal graphic, one of the individuals may be shown falling into the goal graphic (i.e., the mud pit). The individual in the mud pit may then be removed from the challenger graphic to reflect the number of individuals remaining (i.e., the number of individuals that have not fallen into the mud pit). A corresponding decrease in the offset calculated for the challenger may follow in calculation step 312. Thus, for example, the offset may be calculated as (individuals_remaining*challenger_value*challenger_scale). When no individuals remain on the challengers side, for example, step 316 may then determine that the player is the winner.

Note that many parameters values may be adjusted before or during the game to set appropriate difficulty levels. Thus, for example, "scale" may be increased to adjust the player or challenger graphics greater distances on each dart hit independently for the player and the challenger. Furthermore, the influence on the offsets associated with pulling individuals across the sides of the goal graphic may be increased, reduced, or eliminated.

It is further noted that the Tug-of-War dart game disclosed above need not use complicated graphics. As an example, in an alternative embodiment, the display 108 may show a present value which changes as darts hit the target. Thus, for example, the present value may start at 50, with a player goal set (e.g., randomly or in a predetermined manner as influenced by difficulty settings and the like) at 100 and a challenger goal set at 0. The processor 202 may then translate subsequent dart hits by the player into a player value and offset (that is this embodiment is not related to motion of graphics and a pixel count) that is added to the present value. As above, the offset may be determined by many different functions and adjusted according to difficulty level and the like or may simply be set through an identity function to the player value. Similarly, when the processor 202 may translate subsequent dart hits by the challenger into a challenger value and offset that is subtracted from the present value.

Alternatively, a player number may be displayed for the player and a challenger number may be displayed for the challenger. The player number and challenger number may be increased or decreased according to darts hits and corresponding player and challenger values until a common goal or one of two independent goals is reached. Again, play may proceed in turns with the offset calculated after each player has thrown, or as each player throws, or multiple dart targets may be used to provide simultaneous play.

While particular elements, embodiments and applications of the present invention have been shown and described, it is understood that the invention is not limited thereto since modifications may be made by those skilled in the art, particularly in light of the foregoing teaching. It is therefore contemplated by the appended claims to cover such modifications and incorporate those features which come within the spirit and scope of the invention.

What is claimed is:

1. A method of controlling a computerized dart game, the method comprising the steps of:

generating on a display a goal graphic;

generating on a display at least one player graphic and positioning the player graphic on a first side of the goal graphic;

generating on the display at least one challenger graphic and positioning the challenger graphic on a second side of the goal graphic;

monitoring segments in at least one electronic dart board for hits by darts;

determining at least one offset value associated with at least one segment hit by a dart in the electronic dart board;

adjusting on the display the position of the player graphic in relation to the first side of the goal and adjusting the position of the challenger graphic in relation to the second side of the goal based on the at least one offset value.

2. The method of claim 1, wherein the step of determining determines, during a players turn, a player value associated with a first segment hit by a player dart, and further comprising the step of randomly determining, during a challengers turn, a challenger value, and wherein the determining step determines the offset value as a function of the player value and the challenger value.

3. The method of claim 2, further comprising the step of declaring the player a winner when the adjusting step adjusts the position of the challenger graphic on the display to cross the second side of the goal graphic.

4. The method of claim 3, further comprising the step of declaring the challenger a winner when the adjusting step adjusts the position of the player graphic on the display to cross the first side of the goal graphic.

5. The method of claim 1, wherein the monitoring step monitors two independent electronic dart boards.

6. The method of claim 1, wherein the step of determining determines, during a players turn, a player value associated with a first segment hit by a player dart and determines, during a challengers turn, a challenger value associated with a second segment hit by a challenger dart, and wherein the determining step determines the offset value as a function of the player value and the challenger value.

7. The method of claim 6, further comprising the step of declaring the player a winner when the adjusting step adjusts the position of the challenger graphic on the display to cross the second side of the goal graphic.

8. The method of claim 7, further comprising the step of declaring the challenger a winner when the adjusting step adjusts the position of the player graphic on the display to cross the first side of the goal graphic.

9. The method of claim 6, wherein the monitoring step monitors two independent electronic dart boards.

10. A dart game for playing a simulated tug-of-war game wherein darts are thrown at segments in dart boards to adjust player and challenger graphics toward or away from a goal graphic, the dart game comprising:

a first electronic dart board comprising a plurality of segments;

a controller connected to the first electronic dart board;

a display connected to the controller;

a memory connected to the controller, the memory comprising:

instructions that generate a player graphic, a challenger graphic, and a goal graphic for simultaneous depiction display;

instructions that position the player graphic on a first side of the goal graphic, and that position the challenger graphic on a second side of the goal graphic;

instructions that cause the controller to scan segments for hits by darts;

instructions that determine at least one offset value associated with at least one segment hit by a dart; and instructions that adjust on the display, based on the at least one offset value, the player graphic in relation to the first side of the goal graphic and that correspondingly adjust the challenger graphic in relation to the second side of the goal graphic.

11. The dart game of claim 10, wherein the memory further comprises instructions that determine during a players turn, a player value associated with a first segment hit by a player dart, and instructions that randomly determine, during a challengers turn, a challenger value, and instructions that determine the offset value as a function of the player value and the challenger value.

12. The dart game of claim 10, wherein the memory further comprises instructions that declare the player a winner when the position of the challenger graphic on the display crosses the goal graphic.

13. The dart game of claim 12, wherein the memory further comprises instructions that declare the challenger a winner when the position of the player graphic on the display crosses the goal graphic.

14. The dart game of claim 10, further comprising a second electronic dart board comprising a plurality of segments, and wherein the second electronic dart board is connected to the controller.

15. The dart game of claim 10, wherein the memory further comprises: instructions that determine, during a players turn, a player value associated with a first segment hit by a player dart; instructions that determine during a challengers turn a challenger value associated with a second segment hit by a challenger dart; and instructions that determine the offset value as a function of the player value and the challenger value.

16. The dart game of claim 15, wherein the memory further comprises instructions that declare the player a winner when the position of the challenger graphic on the display crosses the goal graphic.

17. The dart game of claim 16, wherein the memory further comprises instructions that declare the challenger a winner when the position of the player graphic on the display crosses the goal graphic.

18. The dart game of claim 15, further comprising a second electronic dart board comprising a plurality of segments, and wherein the second electronic dart board is connected to the controller.

19. A method of controlling a computerized dart game, the method comprising the steps of:

generating a present value and displaying the present value on a display;

determining a player target value;

determining a challenger target value;

monitoring segments in at least one electronic dart board for hits by player darts and by challenger darts, when a challenger is playing;

determining a player offset value associated with a segment hit by the player dart, the player offset determined as a first function of a player value associated with the segment hit by the player dart;

determining a challenger offset value associated with a segment hit by the challenger dart, when the challenger is playing, the challenger offset determined as a second function of a challenger value associated with the segment hit by the challenger dart; and adjusting the present value based on the player offset value and the challenger offset value, when the challenger is playing.

20. The method of claim 19, wherein the step of determining a challenger offset value comprises randomly determining, when the challenger is not playing, the challenger value.

21. The method of claim 20, further comprising the step of declaring the player a winner when the adjusting step adjusts the present value to reach the player target value.

22. The method of claim 20, further comprising the step of declaring the challenger a winner when the adjusting step adjusts the present value to reach the challenger target value.

23. The method of claim 19, wherein the monitoring step monitors two independent electronic dart boards.

24. The method of claim 19, further comprising the step of declaring the player a winner when the adjusting step adjusts the present value to reach the player target value.

25. The method of claim 19, further comprising the step of declaring the challenger a winner when the adjusting step adjusts the present value to reach the challenger target value.

26. The method of claim 25, wherein the monitoring step monitors two independent electronic dart boards.

27. A method of controlling a computerized dart game, the method comprising the steps of:

generating a player number and a challenger number and displaying the player number and the challenger number on a display;

determining a player target value;

determining a challenger target value;

monitoring segments in at least one electronic dart board for hits by darts;

determining an offset value associated with at least one segment hit by a player dart in the electronic dart board;

adjusting the player number toward the player target value and the challenger number away from the challenger target value based on the offset value.

28. The method of claim 27, wherein the step of determining an offset value determines, during a players turn, a player value and a player offset associated with a first segment hit by the player dart, and further comprising the step of randomly determining, during a challengers turn, a challenger value, and a challenger offset, the player offset determined as a first function of the player value, the challenger offset determined as a second function of the challenger value, and wherein the step of adjusting comprises adjusting the player number based on the player offset and adjusting the challenger number based on the challenger offset.

29. The method of claim 28, further comprising the step of declaring the player a winner when the adjusting step adjusts the player number to reach the player target value.

30. The method of claim 28, further comprising the step of declaring the challenger a winner when the adjusting step adjusts the challenger number to reach the challenger target value.

31. The method of claim 27, wherein the monitoring step monitors two independent electronic dart boards.

32. The method of claim 27, wherein the step of determining an offset value determines, during a players turn, a player value and a player offset associated with a first segment hit by the player dart and determines, during a challengers turn, a challenger value and a challenger offset associated with a second segment hit by a challenger dart, the player offset determined as a first function of the player value, the challenger offset determined as a second function of the challenger value, and wherein the step of adjusting comprises adjusting the player number based on the player offset and adjusting the challenger number based on the challenger offset.

33. The method of claim 27, further comprising the step of declaring the player a winner when the adjusting step adjusts the player number to reach the player target value.

34. The method of claim 27, further comprising the step of declaring the challenger a winner when the adjusting step adjusts the challenger number to reach the challenger target value.

35. The method of claim 32, wherein the monitoring step monitors two independent electronic dart boards.

36. A method of controlling a computerized dart game for playing a simulated tug-of-war game, the method comprising the steps of:

monitoring segments in a first electronic dart board for player dart hits;

monitoring segments in a second electronic dart board for challenger dart hits;

determining a player offset value associated with a first segment hit by a player dart, the player offset determined as a first function of a player value associated with the segment hit by the player dart;

determining a challenger offset value associated with a second segment hit by a challenger dart, the challenger offset determined as a second function of a challenger value associated with the segment hit by the challenger dart;

updating a player score based on the player offset value and a challenger score based on the challenger offset value;

determining a score differential between a player score and a challenger score; and determining a winner when the score differential exceeds a predetermined threshold value.

37. The method of claim 36, wherein determining a winner further comprises determining which of the player score and the challenger score is greater.

38. The method of claim 36, wherein updating a player score further comprises updating the player score in accordance with a player difficulty level that increases as the score differential increases, when the player score is less than the challenger score.

39. The method of claim 38, wherein updating a challenger score further comprises updating the challenger score in accordance with a challenger difficulty level that increases as the score differential increases, when the challenger score is less than the player score.

40. The method of claim 38, wherein updating further comprises reducing player values based on the player difficulty level associated with player dart hits.

41. The method of claim 39, wherein updating further comprises reducing challenger values based on the challenger difficulty level associated with challenger dart hits.

42. The method of claim 1, wherein at least one of the player graphic and challenger graphic includes at least two players or challengers.

43. The method of claim 42, further comprising increasing a player difficulty level when one of the players crosses the first side of the goal graphic.

44. The method of claim 43, further comprising increasing a challenger difficulty level when one of the challengers crosses the first side of the goal graphic.

45. The method of claim 43, wherein increasing a player difficulty level further comprises the step of reducing offset value contributions from player dart hits.

46. The method of claim 44, wherein increasing a challenger difficulty level further comprises the step of reducing offset value contributions from challenger dart hits.

* * * * *